US006029810A

United States Patent [19]

Chen

[11] Patent Number: 6,029,810

[45] Date of Patent: Feb. 29, 2000

[54] DRESS BAG AND HANGER ASSEMBLY

[76] Inventor: Shu-Ling Chen, 12F, No. 356, Sec. 2, Ming Chin Rd., Tai Shan Hsiang, Taipei Hsien, Taiwan

[21] Appl. No.: 08/953,659

[22] Filed: Oct. 17, 1997

[51] Int. Cl.[7] ..... A45C 5/12; B65D 81/20

[52] U.S. Cl. ..... 206/287; 206/524.8; 383/23

[58] Field of Search ..... 206/287, 811, 206/524.8; 383/3, 23

[56] References Cited

U.S. PATENT DOCUMENTS

| | | | |
|---|---|---|---|
| 2,309,399 | 1/1943 | Kohl | 206/287 X |
| 2,935,182 | 5/1960 | Cater | 206/287 X |
| 3,903,915 | 9/1975 | Rosaz | 383/3 X |
| 4,779,736 | 10/1988 | Geasland | 206/524.8 |
| 5,141,107 | 8/1992 | Wiedermann et al. | 383/3 X |
| 5,332,095 | 7/1994 | Wu | 206/524.8 |
| 5,450,963 | 9/1995 | Carson | 296/524.8 |
| 5,480,030 | 1/1996 | Sweeney et al. | 206/524.8 |
| 5,746,360 | 5/1998 | Chen | 206/287 X |

FOREIGN PATENT DOCUMENTS

| | | | |
|---|---|---|---|
| 606521 | 12/1934 | Germany | 383/23 |
| 329750 | 2/1991 | Japan | 206/524.8 |
| 4189752 | 7/1992 | Japan | 206/524.8 |
| 4242544 | 8/1992 | Japan | 206/524.8 |
| 206398 | 11/1939 | Switzerland | 206/287 |

*Primary Examiner*—Sue A. Weaver
*Assistant Examiner*—Elizabeth Chen
*Attorney, Agent, or Firm*—Bacon & Thomas, PLLC

[57] ABSTRACT

A dress bag having an open side with a re-sealable closure and a packing strip at one sealed side, an one-way air valve mounted in a through hole of the packing strip for letting air be drawn away from the bag, a swivel hook coupled to the one-way air valve outside the bag, and a swivel hanging ring coupled to the one-way air valve inside the bag.

5 Claims, 5 Drawing Sheets

DRESS BAG AND HANGER ASSEMBLY

BACKGROUND OF THE INVENTION (a) Field Of The Invention

The present invention relates to dress bags, and more particularly to a vacuum compressible dress bag with hanger means.

(b) Description Of The Prior Art

When a suit or precious dress is cleaned and stored in a wardrobe or the like, it is hung on a crossbar inside the wardrobe so that it can be kept in shape. In order to protect a suit or dress against dust, a plastic dress bag may be used. However, a regular plastic dress bag cannot protect the attack of moisture in air. There is known a vacuum compressible dress bag designed for keeping clothes in a vacuum status. This structure of dress bag is equipped with an air valve through which air can be drawn away from the bag by a vacuum cleaner. The air valve is comprised of a valve block fixedly fastened to the dress bag, and a screw cap fastened to the valve block to seal its air hole. When closing the screw cap after air has been drawn away from the dress bag, a certain amount of air may pass through the air hole of the valve block into the inside of the dress bag. There is known another structure of air valve designed for this purpose. This structure of air valve is a type of ball valve. However, this structure of ball valve is still not satisfactory in function. When the screw cap is fastened up, the ball is forced against the periphery of the air hole of the valve block, and the periphery of the air hole tends to be damaged when frequently close and open the air valve.

SUMMARY OF THE INVENTION

It is one object of the present invention to provide a dress bag which has hanger means for hanging on a support so that storage clothes can be maintained in shape. It is another object of the present invention to provide a dress bag which is equipped with an one-way air valve through which air can be drawn away from the bag so that storage clothes can be well protected against dust and moisture. It is still another object of the present invention to provide a dress bag with an one-way air valve which is durable in use, and can positively stop a reverse flow of air when air is drawn away from the bag.

DETAILED DESCRIPTION OF THE PREFERRED EMBODIMENT

Figure 1:
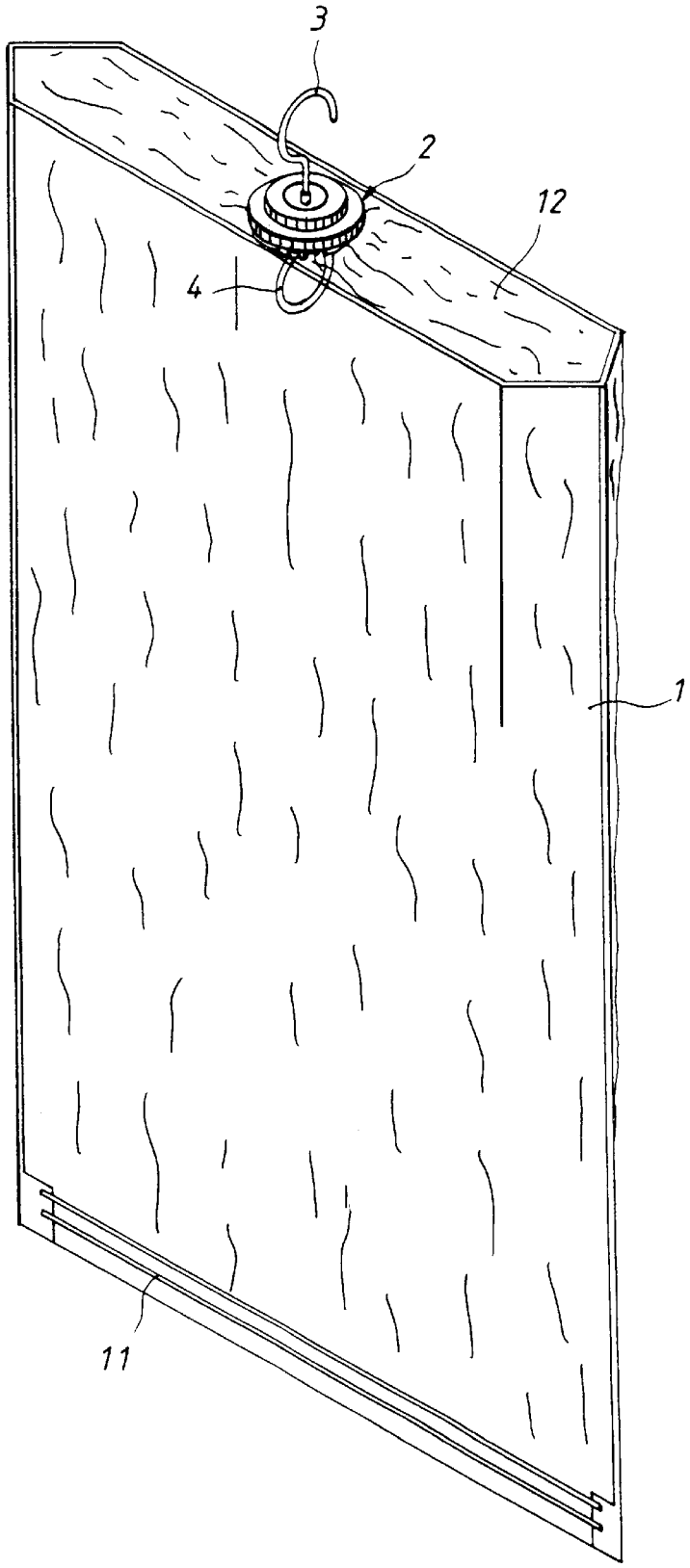
FIG. 1 is a perspective view of a dress bag according to the present invention.

Referring to FIG. 1, a dress bag in accordance with the present invention is generally comprised of a bag 1, an one-way air valve 2, a top swivel hook 3, and a bottom swivel hanging ring 4.

Referring to FIG. 1 again, the bag 1 has three sides sealed with the other side left open and closed by a re-sealable closure 11. A packing strip 12 is integral with one sealed side of the bag 1 opposite to the re-sealable closure 11. The packing strip 12 has a through hole 121.

Figure 2:
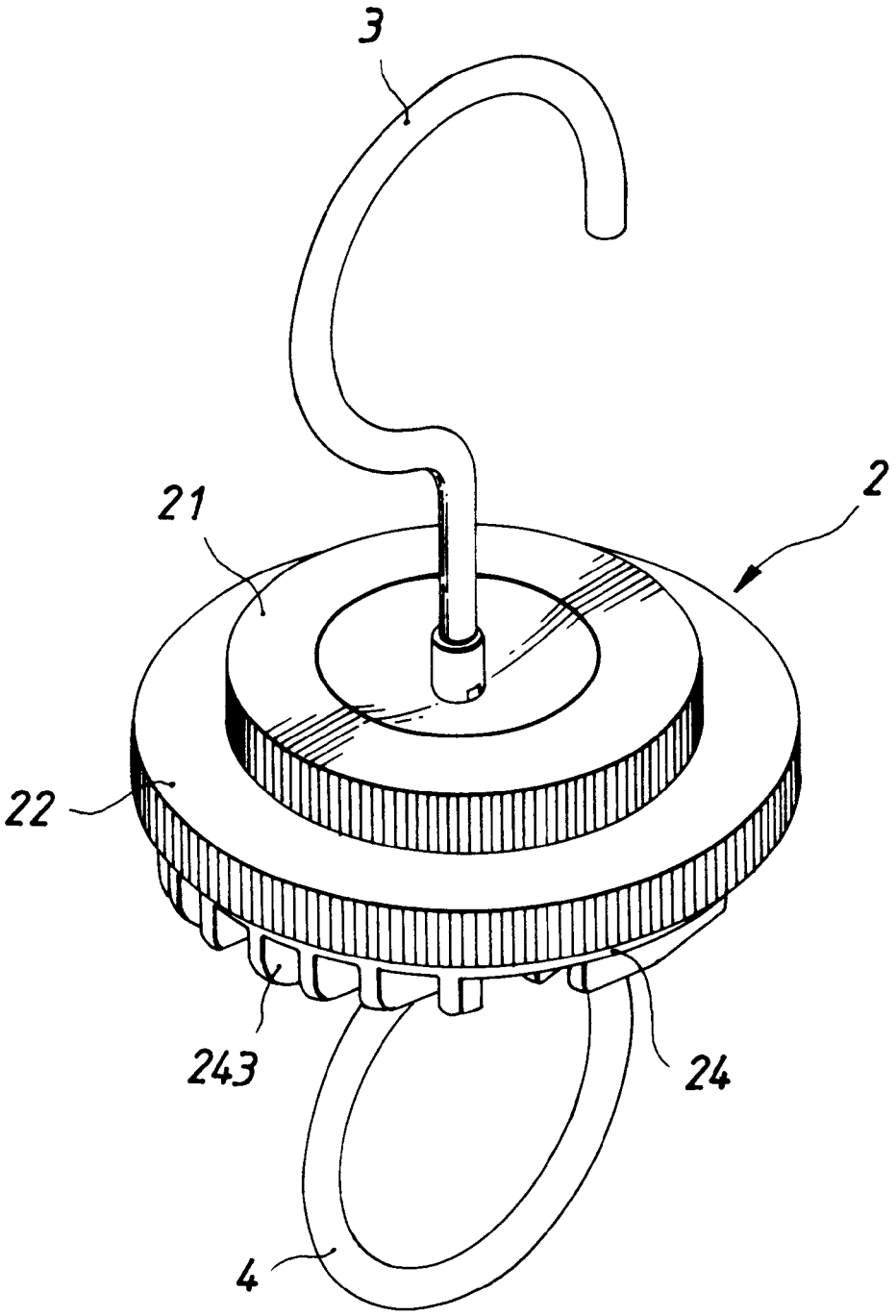
FIG. 2 is an enlarged view of a part of the present invention, showing the one-way air valve, the swivel hook and the swivel hanging ring assembled.
Figure 3:
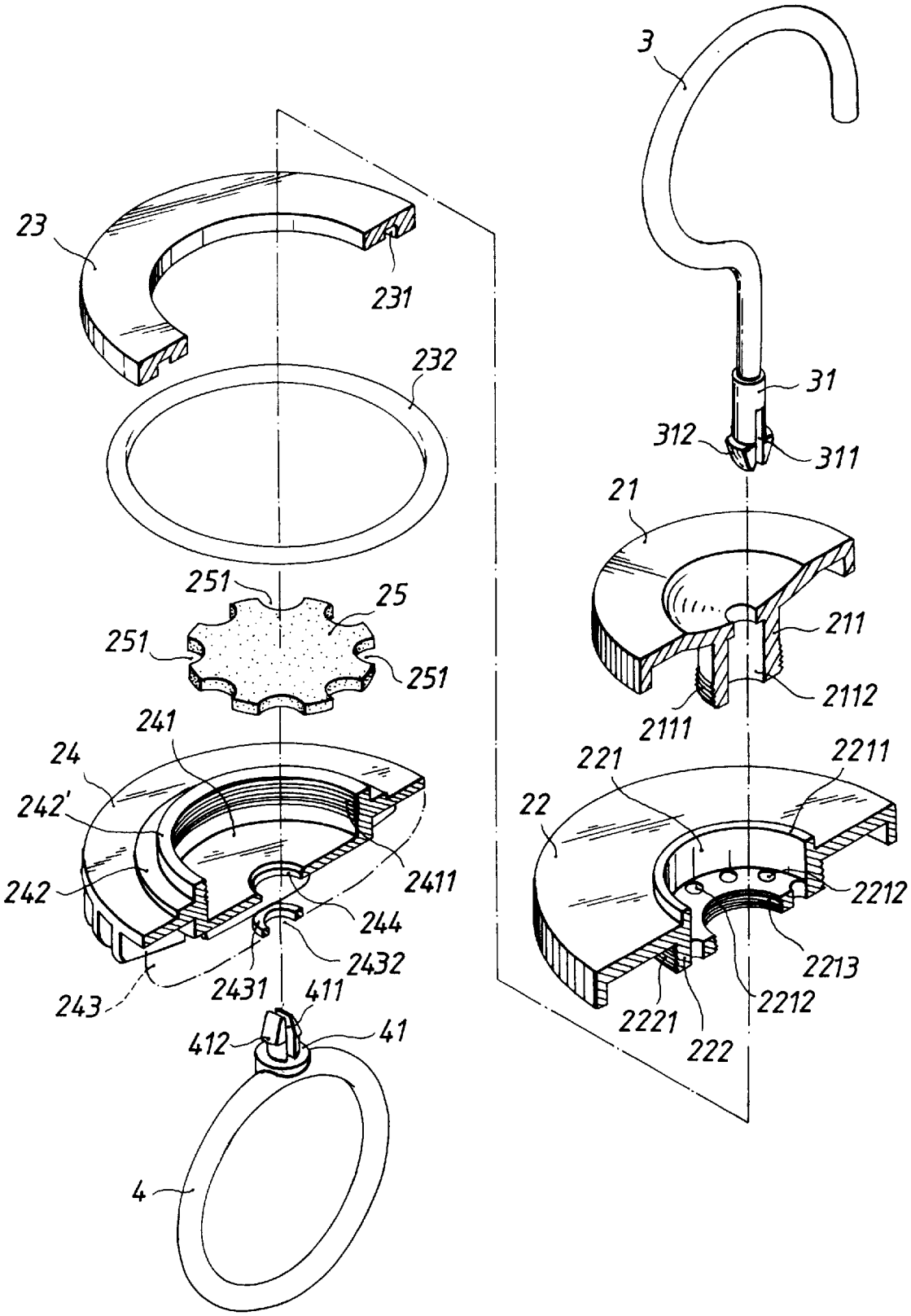
FIG. 3 is an exploded view of the assembly shown in FIG. 2.

Referring to FIGS. 2 and 3 and FIG. 1 again, the one-way air valve 2 is fixedly mounted in the through hole 121 of the packing strip 12 to let air be drawn away from the bag 1 by an air suction means, such as a vacuum pump. The one-way air valve 2 comprises a cap 21, a top valve shell 22, an annular cushion 23, an O-ring 232, a bottom valve shell 24, and a valve flap 25. The cap 21 comprises a downward rod 211 at the center, an outer thread 2111 around the bottom end of the downward rod 211, and a stepped center through hole 2112 pierced through the longitudinal central axis of the downward rod 211. The top valve shell 22 comprises a recessed top chamber 221 at the center, an upwardly extended annular flange 2211 raised from its top side around the recessed top chamber 221, a screw hole 2213 at the center of the recessed bottom chamber 221, a plurality of air vents 2212 respectively pierced through the bottom wall of the recessed top chamber 221 and equiangularly spaced around the screw hole 2213, a downward annular flange 222 raised from its bottom side and spaced around the bottom wall of the recessed top chamber 221, and an outer thread 2221 made around the periphery of the downward annular flange 222. The annular cushion 23 defines a bottom annular groove 231, which receives the O-ring 232. The bottom valve shell 24 comprises a recessed top chamber 241 at the center, a stepped annular flange 242;242' raised from its top side around the recessed top chamber 241, a plurality of fins 243 raised from its bottom side, an inner thread 2411 made along the vertical peripheral wall of the recessed top chamber 241, a center through hole 244 forming an air vent pierced through the center of the bottom wall of the recessed top chamber 241, a stop flange 2431 integral with one fin 243, and a hanging hole 2432 provided at the stop flange 2431. The valve flap 25 is molded from flexible silicon rubber and mounted within the recessed top chamber 241 of the bottom valve shell 24, having a plurality of notches 251 equiangularly spaced around the border. The top hook 3 is mounted in the stepped center through hole 2112 of the swivel cap 21 of the one-way air valve 2. The top swivel hook 3 has a connecting element 31 at one end. The connecting element 31 has a flanged head 312, and a longitudinal split 311 extended through the flanged head 312 in the middle. The bottom swivel hanging ring 4 is mounted in the hanging hole 2432 on the stop flange 2431 of the bottom valve shell 24 of the one-way air valve 2. The bottom swivel hanging ring 4 has a connecting element 41 integral with its periphery. The connecting element 41 has a flanged head 412, and a longitudinal split 411 extended through the flanged head 412 in the middle.

Figure 4:
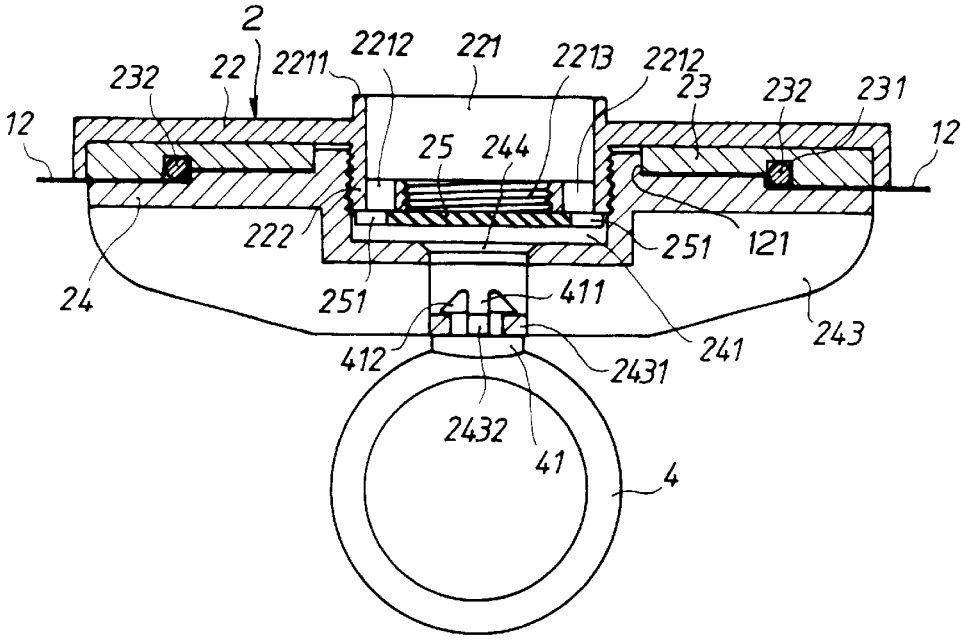
FIG. 4 is a sectional view in an enlarged scale of a part of the present invention, showing the one-way air valve opened.
Figure 5:
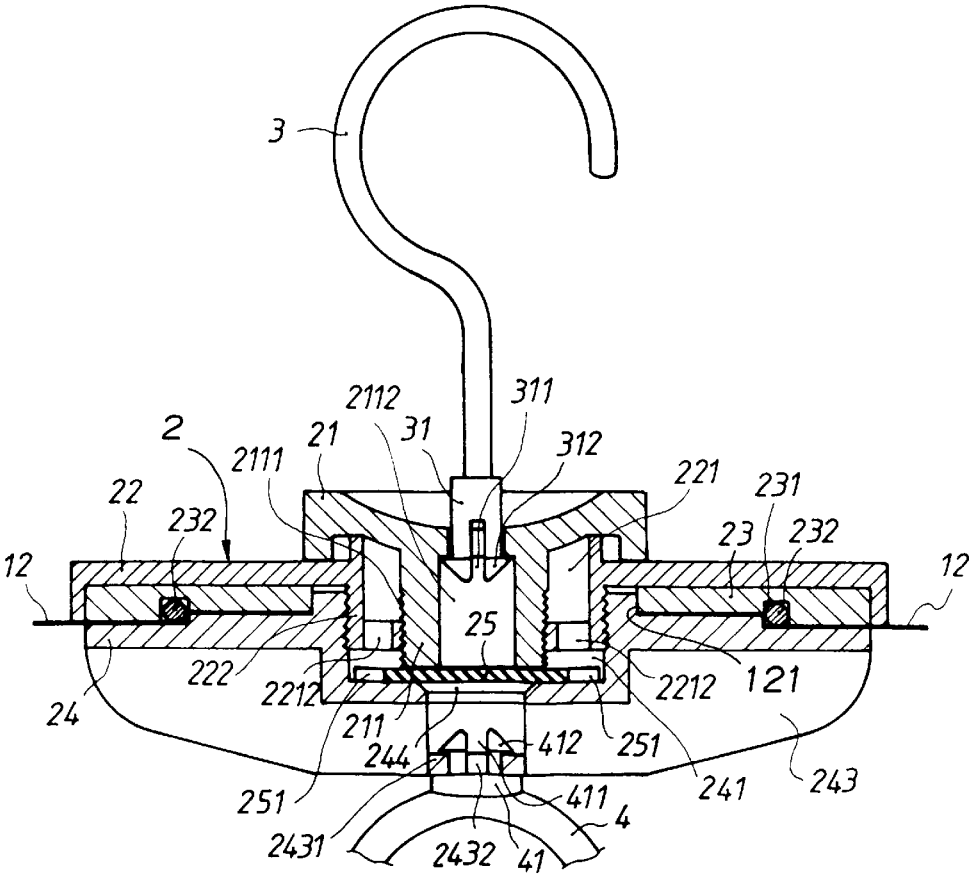
FIG. 5 is a sectional view in an enlarged scale of a part of the present invention, showing the one-way air valve closed.
Figure 6:
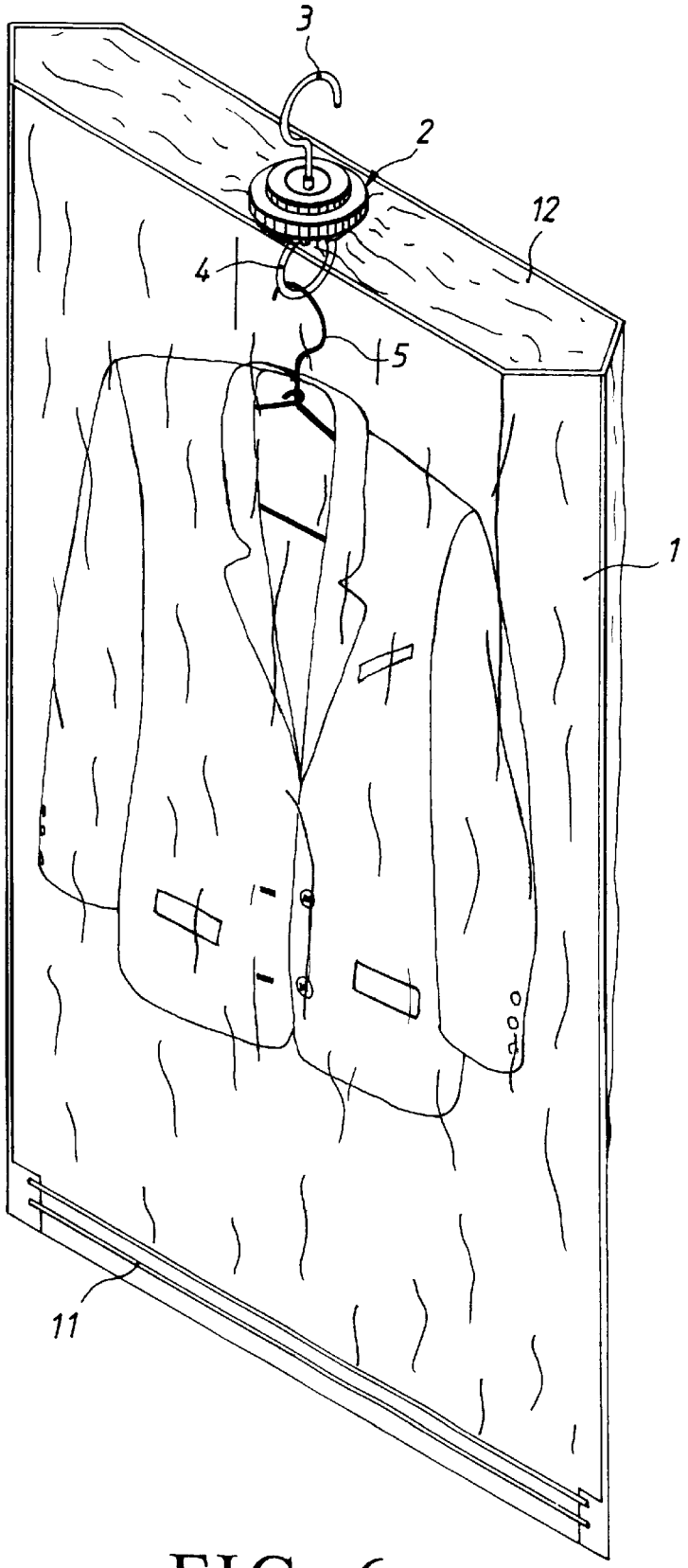
FIG. 6 is an applied view of the present invention.

Referring to FIGS. 4 and 5, and FIGS. 1 and 2 again, the top swivel hook 3, the bottom swivel hanging ring 4 and the one-way air valve 2 are fastened together by: forcing the flanged head 312 of the top swivel hook 3 into engagement with the stepped center through hole 2112 of the cap 21 of the one-way air valve 2 to couple the top hook 3 and the swivel cap 21 together, then forcing the flanged head 412 of the bottom swivel hanging ring 4 into engagement with the hanging hole 2432 on the stop flange 2431 of the bottom valve shell 24 to couple the bottom swivel hanging ring 4 and the bottom valve shell 24 together. The one-way air valve 2 and the bag 1 are assembled by: putting the bottom valve shell 24 inside the bag 1 and inserting the stepped annular flange 242;242' into the through hole 121 on the packing strip 12, then putting the valve flap 25 in the recessed top chamber 241 of the bottom valve shell 24 over hole 244, and then mounting the annular cushion 23 on the bottom valve shell 24 around the stepped annular flange 242;242' outside the bag 1 with the O-ring 232 retained in the bottom annular groove 231 in close contact with the outside wall of the bag 1, and then covering the top valve shell 22 on the bottom valve shell 24 over the annular cushion 23, permitting the outer thread 2221 of the top valve shell 22 to be threaded into the inner thread 2411 of the bottom valve shell 24, and then fastening the cap 21 to the top valve shell 22, by engaging the outer thread 2111 of the cap 21 with the inner thread 2213 of the bottom valve shell 23. When assembled, the downward rod 211 of the cap 21 engages the top side of the valve flap 25 (see FIG. 5).

When in use, the re-sealable closure 11 is opened, then the dress to be stored is hung on a dress hanger 5 and then put inside the bag 1, permitting the dress hanger 5 to be hung on the hanging ring 4, and then the closure 11 is closed, and then the swivel cap 21 is loosened and disconnected from the top valve shell 22, and then an air suction means for example a vacuum cleaner is attached to the one-way air valve 2 and operated to draw air away from the bag 1. When the vacuum cleaner starts to draw air away from the bag 1, the valve flap 25 is lifted from the air vent 244 by suction force, permitting air to flow from the inside of the bag 1 through the air vent 244 of the bottom valve shell 24, the notches 251 at the border of the valve flap 25 and the air vents 2212 of the top valve shell 22 to the outside of the bag 1 (see FIG. 4). When the vacuum cleaner is stopped, the valve flap 25 returns to its former position to close the air vent 244 due to the vacuum effect of the vacuum state of the bag 1, and the cap 21 is then fastened to the top valve shell 22 again to hold down the valve flap 25. By means of the top swivel hook 3, the dress bag can be hung on a crossbar of a wardrobe or the like.

While only one embodiment of the present invention has been shown and described, it will be understood that various modifications and changes could be made thereunto without departing from the spirit and scope of the invention disclosed.

What the invention claimed is:

1. A dress bag and hanger assembly comprising:

a) a bag having an open side, a sealed side, a resealable closure for closing the open side, and a packing strip at the sealed side, the packing strip having a hole formed therethrough;

b) an one-way air valve mounted in the hole of the packing strip for permitting air to be drawn away from the bag through an air passage of the air valve, the air valve including a bottom valve shell fastened through the hole of the packing strip inside the bag, a top valve shell fastened through the hole of the packing strip outside the bag, a cap fastened to the top valve shell outside the bag, an annular cushion mounted between the bottom valve shell and the top valve shell around the hole of the packing strip outside the bag, and a valve flap mounted between the bottom valve shell and the top valve shell and the valve flap being engaged by the cap to close the air passage;

c) a swivel hook coupled to the cap outside the bag;

d) a swivel hanging ring coupled to the bottom valve shell inside the bag; and e) the cap including a threaded downward rod at a center thereof, the rod being threaded into a screw hole in the top valve shell and engaged against the valve flap, and a stepped center hole extending along a longitudinal central axis of the rod for receiving the swivel hook.

2. A dress bag and hanger assembly comprising:

a) a bag having an open side, a sealed side, a resealable closure for closing the open side, and a packing strip at the sealed side, the packing strip having a hole formed therethrough;

b) an one-way air valve mounted in the hole of the packing strip for permitting air to be drawn away from the bag through an air passage of the air valve, the air valve including a bottom valve shell fastened through the hole of the packing strip inside the bag, a top valve shell fastened through the hole of the packing strip outside the bag, a cap fastened to the top valve shell outside the bag, an annular cushion mounted between the bottom valve shell and the top valve shell around the hole of the packing strip outside the bag, and a valve flap mounted between the bottom valve shell and the top valve shell and the valve flap being engaged by the cap to close the air passage;

c) a swivel hook coupled to the cap outside the bag;

d) a swivel hanging ring coupled to the bottom valve shell inside the bag; and e) the top valve shell including a recessed top chamber at a center thereof, an annular flange extending around the recessed top chamber and upwardly therefrom, the top chamber including a bottom wall, a screw hole extending through a center of the bottom wall for securing the cap to the top valve shell, a plurality of air vents equiangularly spaced around the screw hole, an annular flange extending downwardly from a bottom side thereof, and the downwardly extending flange including an outer thread around the periphery thereof for securing the top valve shell to the bottom valve shell.

3. A dress bag and hanger assembly comprising:

a) a bag having an open side, a sealed side, a resealable closure for closing the open side, and a packing strip at the sealed side, the packing strip having a hole formed therethrough;

b) an one-way air valve mounted in the hole of the packing strip for permitting air to be drawn away from the bag through an air passage of the air valve, the air valve including a bottom valve shell fastened through the hole of the packing strip inside the bag, a top valve shell fastened through the hole of the packing strip outside the bag, a cap fastened to the top valve shell outside the bag, an annular cushion mounted between the bottom valve shell and the top valve shell around the hole of the packing strip outside the bag, and a valve flap mounted between the bottom valve shell and the top valve shell and the valve flap being engaged by the cap to close the air passage;

c) a swivel hook coupled to the cap outside the bag;

d) a swivel hanging ring coupled to the bottom valve shell inside the bag; and e) the annular cushion further including a bottom annular groove, and an O-ring disposed within the bottom annular groove.

4. A dress bag and hanger assembly comprising:

a) a bag having an open side, a sealed side, a resealable closure for closing the open side, and a packing strip at the sealed side, the packing strip having a hole formed therethrough;

b) an one-way air valve mounted in the hole of the packing strip for permitting air to be drawn away from the bag through an air passage of the air valve, the air valve including a bottom valve shell fastened through the hole of the packing strip inside the bag, a top valve shell fastened through the hole of the packing strip outside the bag, a cap fastened to the top valve shell outside the bag, an annular cushion mounted between the bottom valve shell and the top valve shell around the hole of the packing strip outside the bag, and a valve flap mounted between the bottom valve shell and the top valve shell and the valve flap being engaged by the cap to close the air passage;

c) a swivel hook coupled to the cap outside the bag;

d) a swivel hanging ring coupled to the bottom valve shell inside the bag; and e) the bottom valve shell including a recessed top chamber at a center thereof for receiving the valve flap, a stepped annular flange extending around the recessed top chamber and upwardly from a top side of the bottom valve shell for securing the annular cushion, a plurality of fins extending from a bottom side thereof, an inner thread formed within the recessed top chamber for mounting the top valve shell to the bottom valve shell, a center hole for permitting air to be drawn away from the bag, a stop flange integral with one of the fins, and a hole formed at the stop flange for securing the swivel hanging ring.

5. A dress bag and hanger assembly comprising:

a) a bag having an open side, a sealed side, a resealable closure for closing the open side, and a packing strip at the sealed side, the packing strip having a hole formed therethrough;

b) an one-way air valve mounted in the hole of the packing strip for permitting air to be drawn away from the bag through an air passage of the air valve, the air valve including a bottom valve shell fastened through the hole of the packing strip inside the bag, a top valve shell fastened through the hole of the packing strip outside the bag, a cap fastened to the top valve shell outside the bag, an annular cushion mounted between the bottom valve shell and the top valve shell around the hole of the packing strip outside the bag, and a valve flap mounted between the bottom valve shell and the top valve shell and the valve being engaged by the cap to close the air passage;

c) a swivel hook coupled to the cap outside the bag;

d) a swivel hanging ring coupled to the bottom valve shell inside the bag; and e) the bottom valve shell includes a recessed top chamber, the valve flap is molded from flexible silicon rubber and includes a plurality of notches equiangularly spaced around a border thereof, and the valve flap is mounted within the recessed top chamber.

* * * * *